US010070759B2

(12) United States Patent
Toh et al.

(10) Patent No.: US 10,070,759 B2
(45) Date of Patent: Sep. 11, 2018

(54) DISPENSER

(71) Applicant: COLGATE-PALMOLIVE COMPANY, New York, NY (US)

(72) Inventors: Kiat-Cheong Toh, Forest Hills, NY (US); Joseph Knorr, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 143 days.

(21) Appl. No.: 14/923,884

(22) Filed: Oct. 27, 2015

(65) Prior Publication Data

US 2017/0112330 A1 Apr. 27, 2017

(51) Int. Cl.

| | |
|---|---|
| ***A47K 5/12*** | (2006.01) |
| ***A47K 5/14*** | (2006.01) |
| ***B05B 11/00*** | (2006.01) |

(52) U.S. Cl.

CPC ..... *A47K 5/14* (2013.01); *A47K 5/1205* (2013.01); *A47K 5/1211* (2013.01); *B05B 11/0054* (2013.01); *B05B 11/0097* (2013.01); *B05B 11/3081* (2013.01)

(58) Field of Classification Search

CPC ..... A47K 5/14; A47K 5/12; A47K 5/1211; A47K 5/1205; B05B 11/0097; B05B 11/3081; B05B 11/0054; B65D 81/325; B65D 83/682

USPC ..... 222/145.1, 145.3–145.6, 145.8

See application file for complete search history.

(56) References Cited

U.S. PATENT DOCUMENTS

| | | | | |
|---|---|---|---|---|
| 3,722,750 | A | 3/1973 | Fox, Jr. | |
| 4,279,362 | A | 7/1981 | Pursell | |
| 4,355,739 | A * | 10/1982 | Vierkotter | B05B 11/3081 222/134 |
| 6,540,109 | B1 | 4/2003 | Klima et al. | |
| 7,118,012 | B2 * | 10/2006 | Butler | B05B 11/0081 222/129 |
| 8,925,766 | B2 | 1/2015 | Gray et al. | |
| 9,027,790 | B2 | 5/2015 | Ciavarella et al. | |
| 2001/0025859 | A1 * | 10/2001 | Dumont | B05B 11/3081 222/136 |
| 2016/0310977 | A1 * | 10/2016 | Arvanitidoou | B05B 11/3081 |

(Continued)

FOREIGN PATENT DOCUMENTS

KR 10-2013-0000165 1/2013

OTHER PUBLICATIONS

International Search Report and Written Opinion of related International Application No. PCT/US2016/058813 dated Dec. 8, 2016.

(Continued)

*Primary Examiner* — Patrick M Buechner
*Assistant Examiner* — Robert Nichols, II

(57) ABSTRACT

A dispenser includes a housing, a cartridge, and a pump assembly. The housing defines an internal volume. The cartridge is coupled with the housing. The pump assembly includes a tube that extends through the cartridge and into the internal volume of the housing. The tube includes a first inlet through which a first liquid is drawn into the tube from the internal volume when the pump assembly is actuated, and a second inlet through which a second liquid is drawn into the tube from the cartridge when the pump assembly is actuated.

11 Claims, 7 Drawing Sheets

(56) References Cited

U.S. PATENT DOCUMENTS

| | | | | |
|---|---|---|---|---|
| 2017/0112331 | A1* | 4/2017 | Toh | A47K 5/14 |
| 2017/0173612 | A1* | 6/2017 | Knorr | B05B 7/30 |

OTHER PUBLICATIONS

Can Your Bottle Do This? https://www.youtube.com/watch?v=AZmO3Pw6ka8, date unknown but prior to the date of the application, screenshots of 30 second video, 11 pp.
My Clean Path, http://www.mycleanpath.com/, date unknown but prior to the date of the application, 12 pp.

* cited by examiner

DISPENSER

BACKGROUND

Hand soap is typically sold in a dispenser that includes a housing and a pump assembly. The hand soap is disposed within the housing. When a user actuates the pump assembly (e.g., by pressing downward), the soap flows out through a nozzle in the pump assembly as a (e.g., foaming) hand soap.

In another embodiment, the dispenser may be sold to the user with no soap inside. The user may pour a measured amount of concentrated soap into the housing through a first end of the housing, and pour a measured amount of water into the housing through a second end of the housing. The concentrated soap and water mix together in the housing. When a user actuates the pump assembly (e.g., by pressing downward), the mixture flows out through a nozzle in the pump assembly as a (e.g., foaming) hand soap. When the concentrated soap and water mixture is exhausted, the user may pour additional measured amounts of concentrated soap and water into the housing, so that the dispenser may continue to be used. What is needed, however, is an improved system and method for refilling a dispenser after the soap is exhausted.

BRIEF SUMMARY

A dispenser is disclosed. The dispenser includes a housing, a cartridge, and a pump assembly. The housing defines an internal volume. The cartridge is coupled with the housing. The pump assembly includes a tube that extends through the cartridge and into the internal volume of the housing. The tube includes a first inlet through which a first liquid is drawn into the tube from the internal volume when the pump assembly is actuated, and a second inlet through which a second liquid is drawn into the tube from the cartridge when the pump assembly is actuated.

A cartridge configured to be coupled with a housing of a dispenser is also disclosed. The cartridge includes an outer portion, an inner portion, and a connecting member. The outer portion has a liquid disposed therein. The inner portion has a bore extending axially-therethrough. The connecting member fluidly couples the outer portion to the inner portion.

A method for using a dispenser is also disclosed. The method includes pouring a first liquid into a housing. A cartridge is coupled with the housing. A second liquid is disposed in the cartridge. A tube of a pump assembly is inserted through an axial bore in an inner portion of the cartridge. A lid of the pump assembly is coupled to the housing. The pump assembly is actuated, thereby causing the first liquid to be drawn into the tube from the housing through a first inlet in the tube and the second liquid to be drawn into the tube from the cartridge through a second inlet in the tube.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
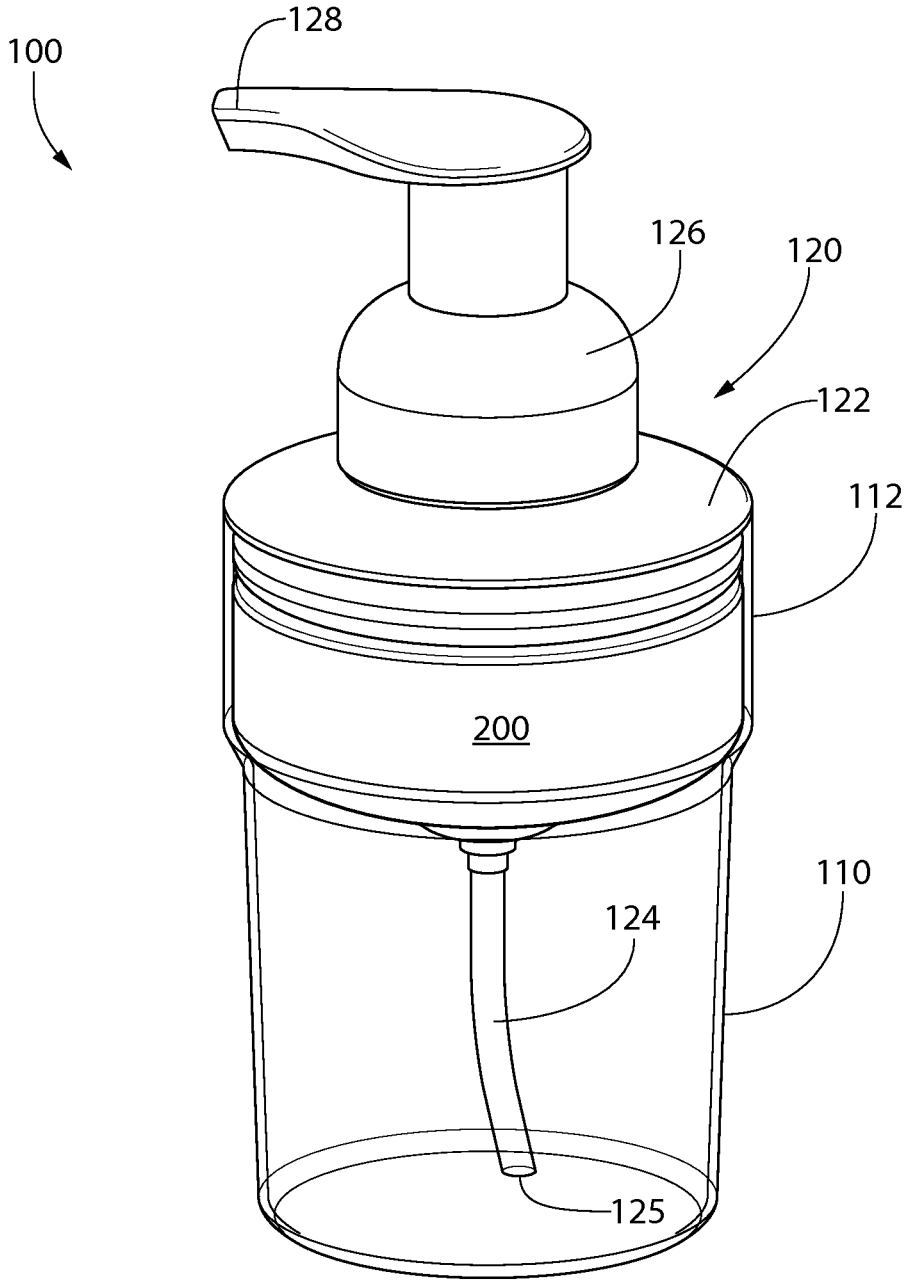
FIG. 1 depicts a perspective view of an example of a dispenser including a housing, a cartridge, and a pump assembly.

FIG. 1 depicts a perspective view of an example of a dispenser 100. Although the dispenser 100 is described below as a foaming hand soap dispenser, in other embodiments, the dispenser 100 may be used to dispense other liquids, such as body wash, facial cleanser, hair care or styling products, surface cleaner detergents, hand sanitizer, skin moisturizers, cosmetic or therapeutic skin products, or the like.

The dispenser 100 may include a housing 110 that defines an internal volume. A cartridge 200 may be (removably) positioned at least partially within the internal volume of the housing 110. As shown, the cartridge 200 may be positioned proximate to an upper, open end 112 of the housing 110. A pump assembly 120 may be configured to be coupled to the housing 110. The pump assembly 120 may also be positioned proximate to the upper, open end 112 of the housing 110.

The pump assembly 120 may include a lid 122 that may be coupled to the housing 110. For example, the lid 122 may be coupled to the housing via a threaded engagement, a bayonet-style twist lock, a press fit, a hinged latch, an elastomeric seal, or a combination thereof. The pump assembly 120 may also include a tube 124 that extends through the lid 122 and the cartridge 200 and at least partially into the internal volume of the housing 110 (e.g., below the cartridge 200). The pump assembly 120 may also include a pump 126 that is configured to be actuated by a user. For example, the user may press downward on the pump 126, which may cause a first liquid to be drawn into the tube 124 through a first inlet 125 of the tube 124 and be ejected from the pump assembly 120 to through an outlet (e.g., a nozzle) 128. The first liquid may be or include water, surfactant, or a combination thereof.

Figure 2:
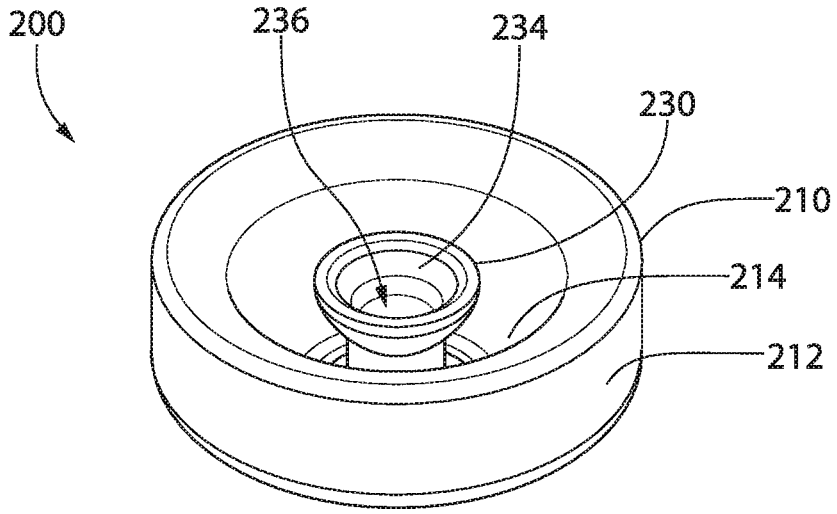
FIG. 2 depicts a perspective view of the cartridge.
Figure 3:
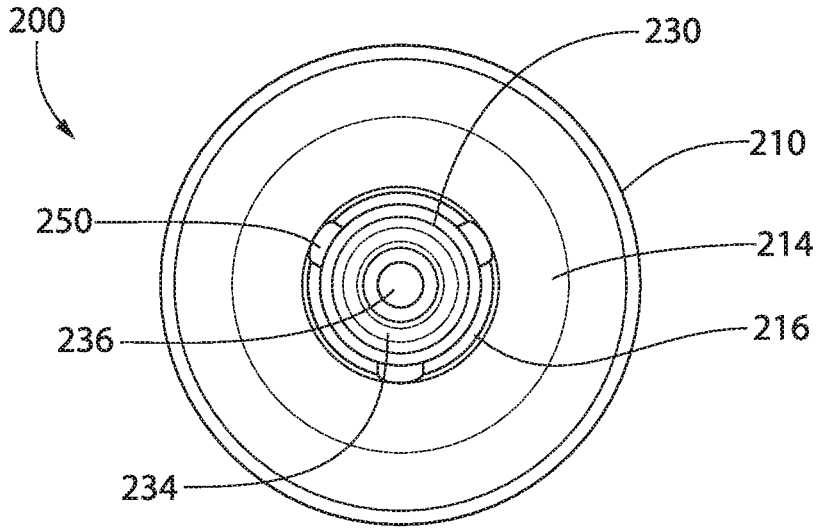
FIG. 3 depicts a top view of the cartridge.

FIG. 2 depicts a perspective view of the cartridge 200, and FIG. 3 depicts a top view of the cartridge 200. The cartridge 200 may include an outer portion 210 and an inner portion 230. As shown, an outer surface 212 of the outer portion 210 may be substantially circular; however, as will be appreciated, the shape of the outer surface 212 may vary depending on and to cooperate with the shape of the housing 110. An inner surface 214 of the outer portion 210 may be substantially frustoconical, with a cross-sectional length (e.g., diameter) of the inner surface 214 decreasing moving downward, e.g., in the direction of the housing 110 with the cartridge 200 is mounted. As described in greater detail below, the frustoconical inner surface 214 may form a funnel. The first liquid (e.g., water) may be poured into the funnel, which may direct the first liquid to flow through one or more axial openings 216 formed between the outer portion 210 and the inner portion 230 and into the housing 110 to fill (or refill) the internal volume of the housing 110. The axial openings 216 and bore 236 may also serve as a vent for air to pass through when the housing 110 is filled with the first liquid (e.g., water) through the cartridge 200, or when the dispenser 100 is used.

The inner portion 230 may be positioned (e.g., radially) inward from the outer portion 210. The inner portion 230 may be coupled to the outer portion 210 via one or more connecting members (three are shown in this example: 250). The connecting members 250 may be circumferentially-offset from one another. The inner portion 230 may have a bore 236 formed axially-therethrough. An inner surface 234 of the inner portion 230 may be substantially frustoconical, with a cross-sectional length (e.g., diameter) of the inner surface 234 decreasing moving downward. As described in greater detail below, the frustoconical inner surface 234 may form a funnel that facilitates insertion of the tube 124 into the axial bore 236.

Figure 4:
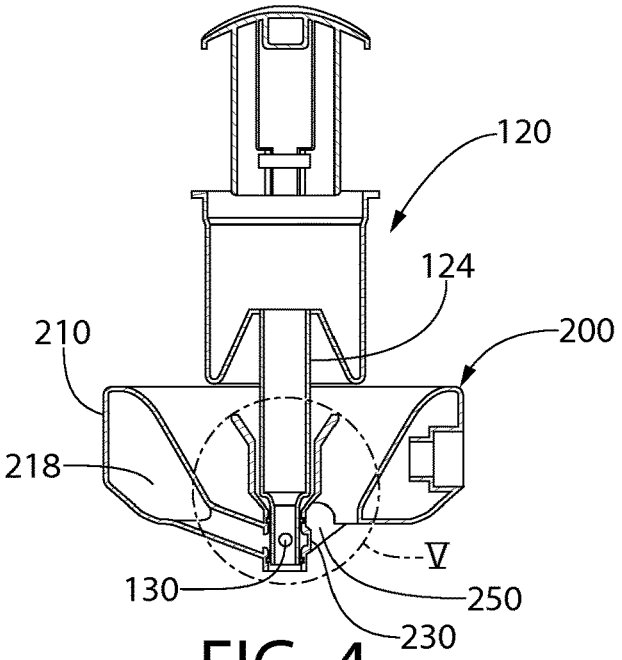
FIG. 4 depicts a partial cross-sectional view of the cartridge.
Figure 5:
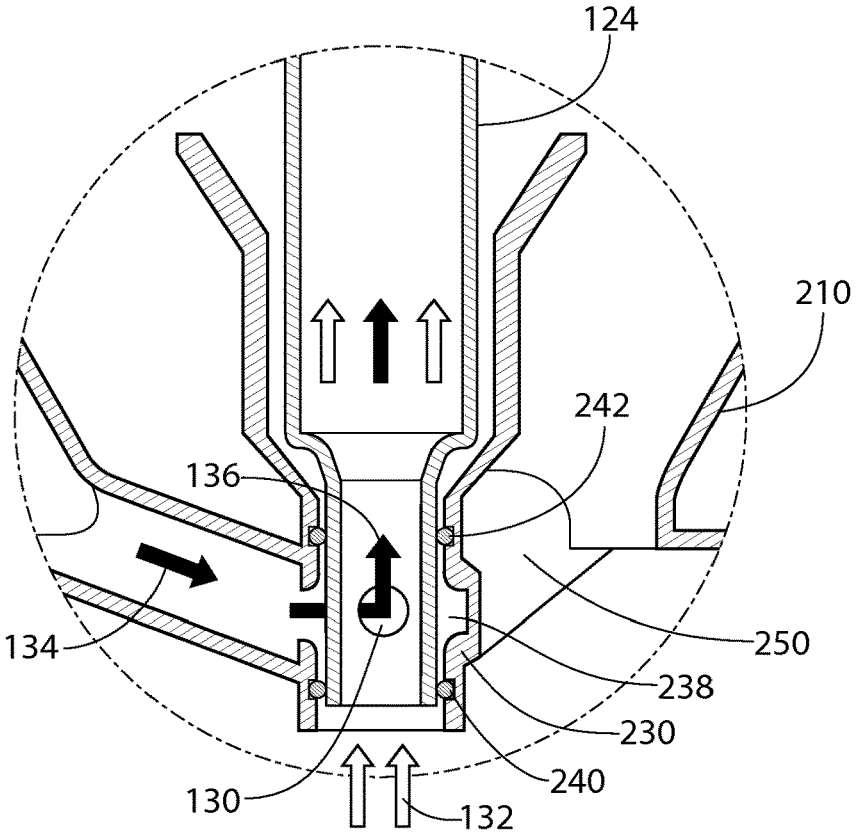
FIG. 5 depicts an enlarged partial cross-sectional view of the cartridge.

FIG. 4 depicts a partial cross-sectional view of the cartridge 200, and FIG. 5 depicts an enlarged partial cross-sectional view of the cartridge 200. The outer portion 210 of the cartridge 200 may define an internal volume 218, and a second liquid may be disposed therein. The second liquid may be or include a concentrated soap, a fragrance, an anti-bacterial liquid, a moisturizer, or a combination thereof.

The connecting members 250 may be hollow and define a flowpath from the internal volume 218 of the outer portion 210 to an annulus 238 formed radially-between the tube 124 of the pump assembly 120 and the inner portion 230 of the cartridge 200. One or more seals (two are shown: 240, 242) may be positioned radially-between the tube 124 of the pump assembly 120 and the inner portion 230 of the cartridge 200. As shown, the first seal 240 may be positioned axially-above the annulus 238, and the second seal 242 may be positioned axially-below the annulus 238. The seals 240, 242 may be, for example, elastomeric O-rings. The tube 124 may include one or more second inlets (one is shown: 130) formed radially-therethrough. The second inlet 130 in the tube 124 may be axially-aligned with the annulus 238. The annulus 238 may be in fluid communication with the second inlet 130 regardless of the radial orientation of the second inlet 130.

The use of the dispenser 100 is now described with reference to FIGS. 1-5. A user may actuate (e.g., press down on) the pump 126, causing the first liquid (e.g., water) in the internal volume of the housing 110 to be drawn into the tube 124 through the first inlet 125 of the tube 124 (see FIG. 1). The first liquid (e.g., water) may flow upward through the tube 124 as shown by arrows 132 in FIG. 5. As the first liquid (e.g., water) flows past the opening 130 in the tube 124, the second liquid (e.g., concentrated soap) may be drawn from the internal volume 218 of the outer portion 210 of the cartridge 200, through the connecting members 250 into the annulus 238, as shown by arrow 134 in FIG. 5. The second liquid (e.g., concentrated soap) may then flow from the annulus 238 into the tube 124 through the second inlet 130, as shown by arrow 136 in FIG. 5. Thus, the second liquid (e.g., concentrated soap) may be combined with the first liquid (e.g., water) inside the tube 124 to form a mixture in response to the user actuating the pump 126. The mixture may be ejected from the dispenser 100 through the outlet 128 of the pump assembly 120 (see FIG. 1). In one embodiment, the mixture may be transformed into a foam as the mixture is ejected, e.g., caused by the geometry of the outlet 128, thereby forming a foaming hand soap.

Figure 6:
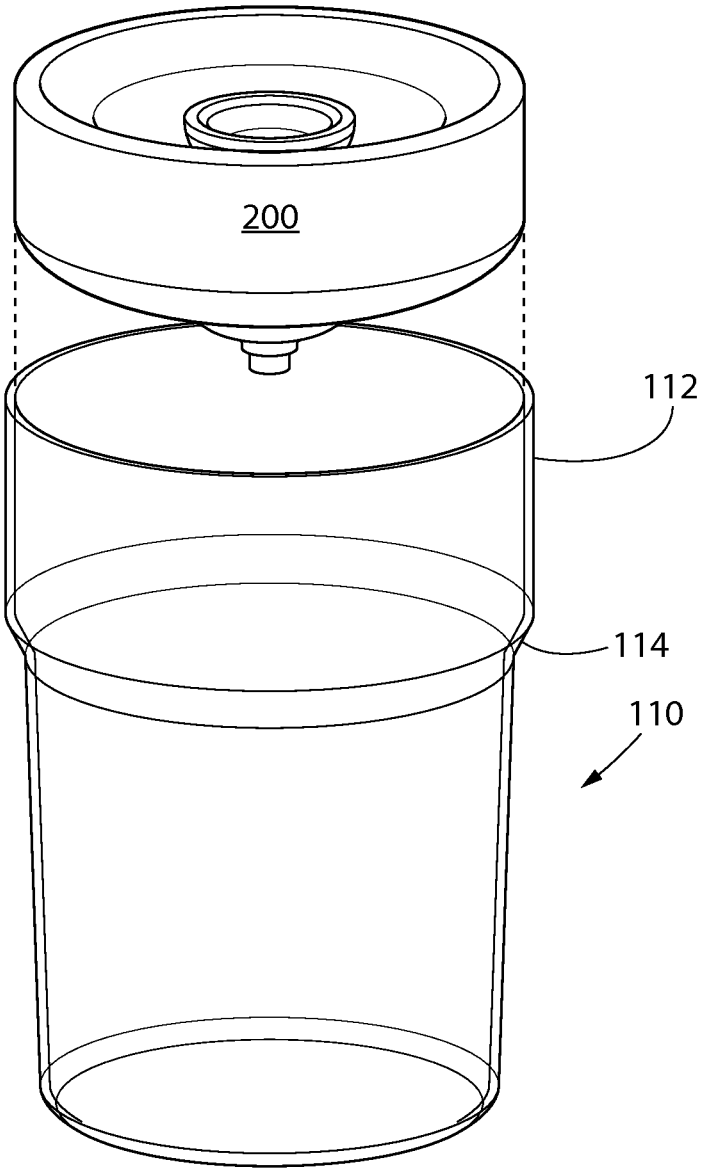
FIG. 6 depicts a perspective view of a user inserting the cartridge into the housing.
Figure 7:
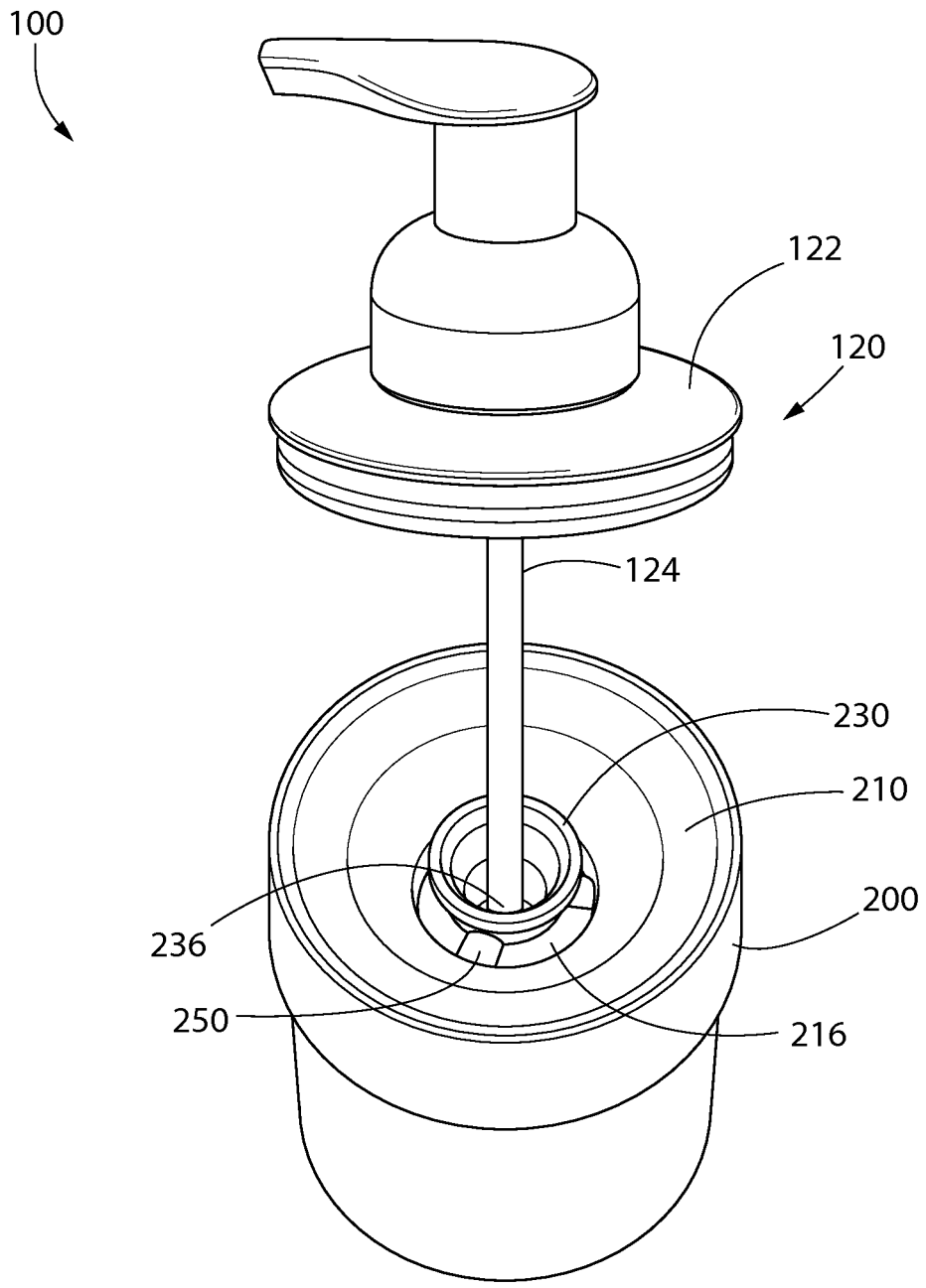
FIG. 7 depicts a perspective view of the user inserting a portion of the pump assembly into the cartridge and the housing.
Figure 8:
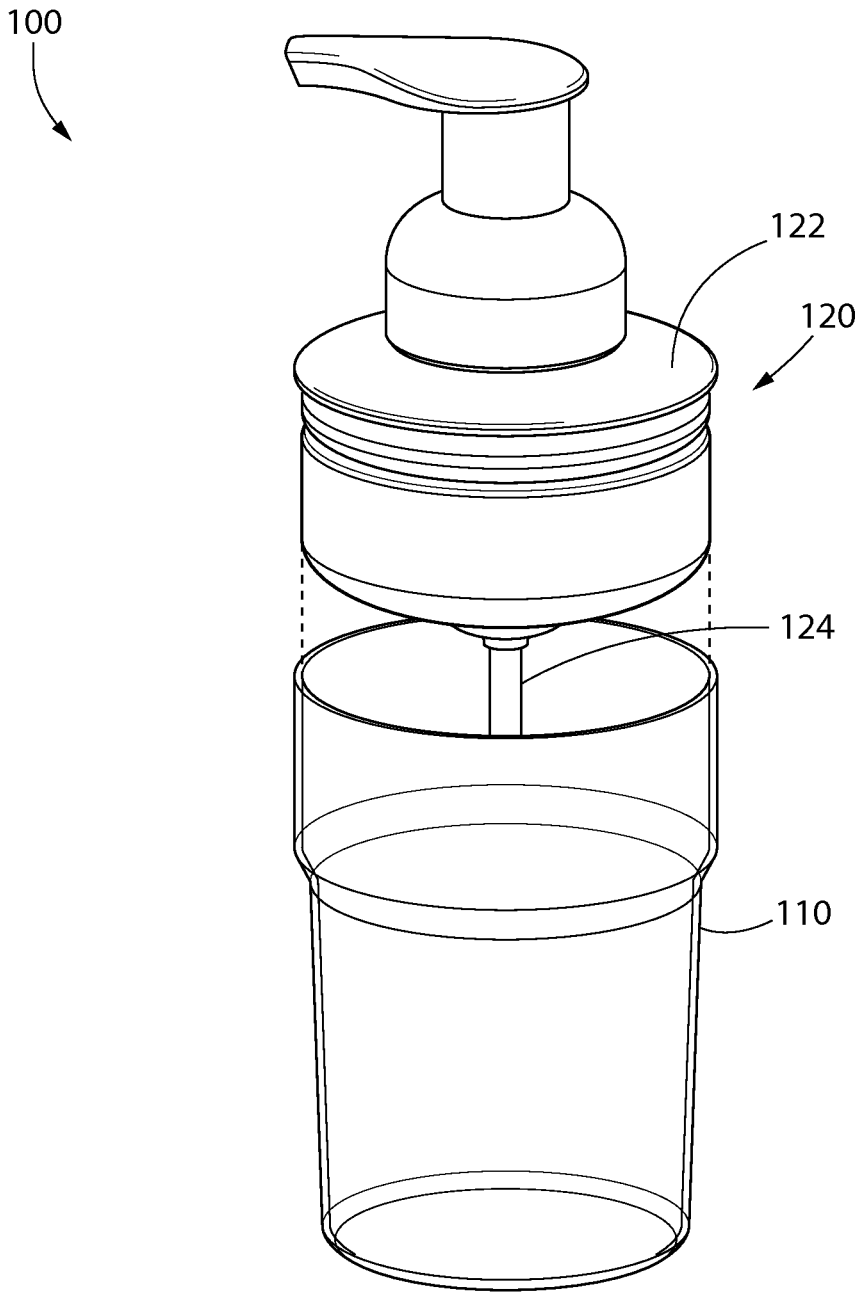
FIG. 8 depicts a perspective view of the user removing the cartridge and the pump assembly from the housing.

FIGS. 6-8 illustrate the assembly and disassembly of the dispenser 100. More particularly, FIG. 6 depicts a perspective view of the user inserting the cartridge 200 into the housing 110. The user may insert the cartridge 200 at least partially into the housing 110 through the open, upper end 112 of the housing 110. The cartridge 200 may rest against a seat or shoulder 114 formed on the inner surface of the housing 110. In some embodiments, the cartridge 200 alternatively may couple to the housing 110 instead of resting on the seat or shoulder 114, and this coupling may form a liquid-tight seal. In one embodiment, the housing 110 may be empty when the cartridge 200 is inserted. In another embodiment, the housing 110 may be at least partially filled with the first liquid (e.g., water) prior to inserting the cartridge 200.

FIG. 7 depicts a perspective view of the user inserting the tube 124 of the pump assembly 120 into the cartridge 200 and the housing 110. If the housing 110 does not already contain the first liquid (e.g., water) before the cartridge 200 is inserted in the housing 110, the user may pour the first liquid (e.g., water) through the cartridge 200 and into the housing 110. The first liquid (e.g., water) may flow through the axial openings 216 in the cartridge 200 and/or through the axial bore 236 in the cartridge 200. The user may then insert the tube 124 of the pump assembly 120 through the axial bore 236 in the cartridge 200. The lid 122 of the pump assembly 120 may then be coupled to the housing 110, forming a liquid-tight seal therebetween. In another embodiment, the pump assembly 120 may additionally be coupled to the cartridge 200. The dispenser 100 may then be used, as described above.

When the first liquid (e.g., water) in the housing 110 is exhausted, the user may decouple the lid 122 of the pump assembly 120 from the housing 110 and at least partially remove the tube 124 from the axial bore 236 of the cartridge 200. The user may then pour additional first liquid (e.g., water) into the internal volume housing 110 (e.g., through the axial openings 216 and/or the axial bore 236). In one embodiment, the housing 110 may include a marking that indicates the maximum fill level in the housing 110. The user may then insert the tube 124 of the pump assembly 120 back through the axial bore 236 in the cartridge 200 and recouple the lid 122 of the pump assembly 120 to the housing 110 again. In another embodiment, the user may refill the dispenser 100 with the first liquid (e.g., water) when the first liquid (e.g., water) is only partially used up (i.e., there is still enough water in the housing 110 for the dispenser 100 to operate).

FIG. 8 depicts a perspective view of the user removing the cartridge 200 and the pump assembly 120 from the housing 110. The cartridge 200 may be transparent or opaque with transparent windows, which may allow the user to determine the amount of the second liquid (e.g., concentrated soap) in the cartridge 200. When the second liquid (e.g., concentrated soap) in the cartridge 200 is at least partially exhausted, the user may decouple the lid 122 of the pump assembly 120 from the housing 110 and remove the pump assembly 120 and the cartridge 200 from the housing 110. As shown, the pump assembly 120 and the cartridge 200 may be removed together due to a friction fit between the pump assembly 120 and the cartridge 200 (e.g., between the tube 124 and the inner portion 230 of the cartridge 200). In another embodiment, the pump assembly 120 may be removed first, and then the cartridge 200 may be removed.

The cartridge 200 may either be disposed of or refilled with additional second liquid (e.g., concentrated soap). A new cartridge (or the refilled cartridge) 200, containing the second liquid (e.g., concentrated soap), may have a seal that prevents the second liquid (e.g., concentrated soap) from leaking out. The seal may be, for example, a blow/fill/seal, a lidding film, a sticker, a plug, a screw cap, a snap cap, a valve, or a combination thereof. In one embodiment, the seal may be a plug that is inserted into the bore 236 to span the annulus 238. Insertion of the pump assembly 120 (e.g., the tube 124) may push the plug downward, causing it to unseal. In other embodiments, the seal may be or include caps or lidding film sealing both ends of bore 236.

The new or refilled cartridge 200 may then be inserted at least partially into the housing 110, as described above. The seal may be removed prior to or during the insertion process. The dispenser 100 may then once again be ready for use. In another embodiment, the user may refill or replace the cartridge 200 when the second liquid (e.g., concentrated soap) is only partially used up (i.e., there is still enough of the second liquid in the cartridge 200 for the dispenser 100 to operate).

Figure 9:
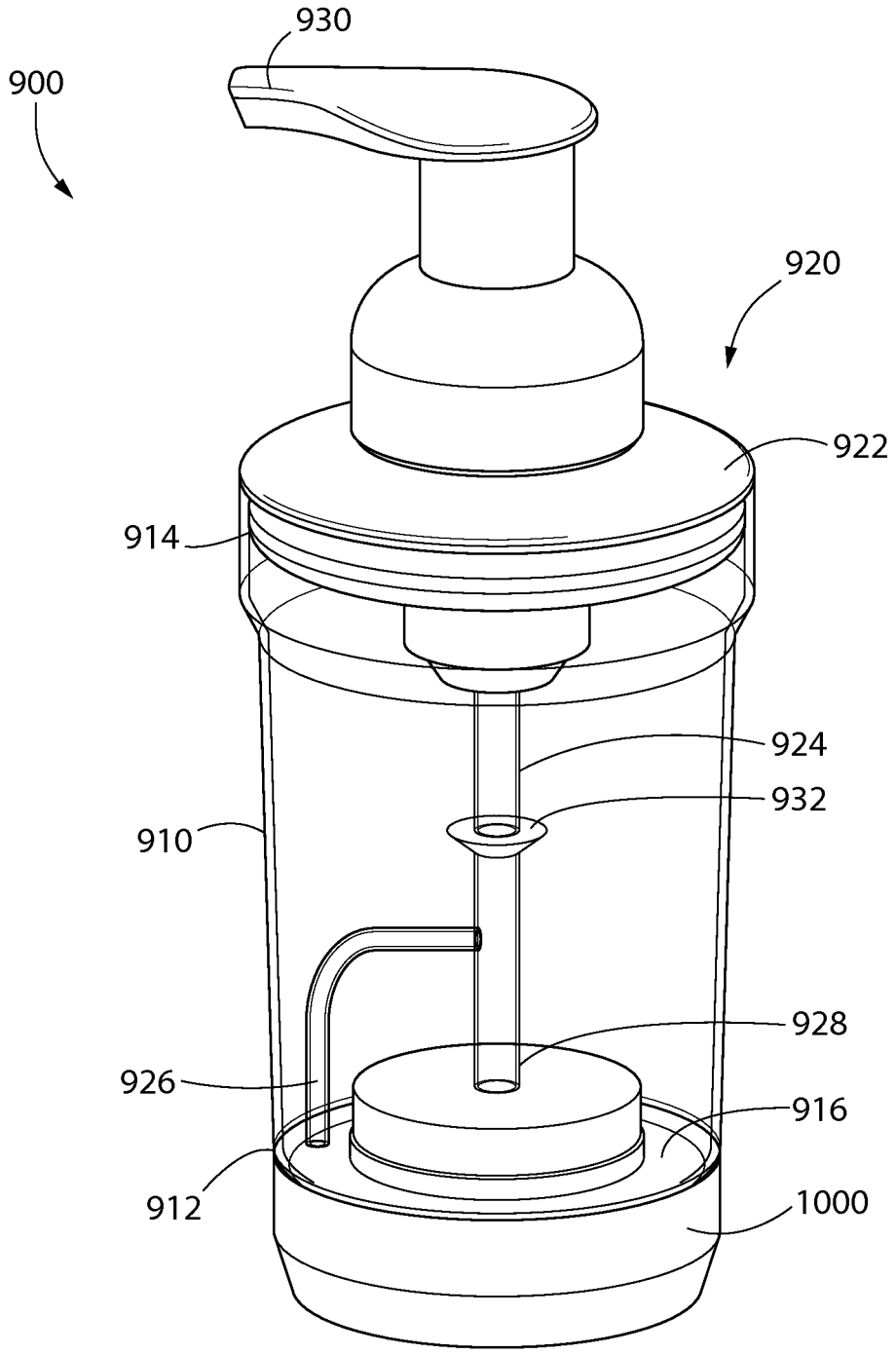
FIG. 9 depicts a perspective view of a different example of a dispenser.

FIG. 9 depicts a perspective view of an example of a different dispenser 900. The dispenser 900 may include a housing 910 having an open lower end 912 and an open upper end 914. A cartridge 1000 may be coupled to and/or positioned at least partially within the lower end 912 of the housing 910. For example, the cartridge 1000 may include threads that are configured to engage corresponding threads on the housing 910 as the cartridge 1000 is screwed onto the housing 910. As shown, an outer surface of the cartridge 1000 may be substantially circular; however, as will be appreciated, the shape of the outer surface may vary depending on the shape of the housing 910. The cartridge 1000 may define an internal volume having a first liquid (e.g., concentrated soap) disposed therein.

The dispenser 900 may also include a pump assembly 920. The pump assembly 920 may include a lid 922 that is configured to be coupled to and/or positioned at least partially within the upper end 914 of the housing 910. The pump assembly 920 may also include a tube 924 that extends through the lid 922 and at least partially into the internal volume of the housing 910. The tube 924 may include a first inlet 926 that is configured to be positioned within the internal volume of the housing 910, proximate to the lower end 912 of the housing 910 (and not positioned within the cartridge 1000). The tube 924 may also include a second inlet 928 that is configured to be inserted at least partially into the cartridge 1000 when the pump assembly 920 and the cartridge 1000 are coupled to the housing 910. In another embodiment, the portion of the tube 924 that includes the first inlet 926 and the second inlet 928 may be coupled to or integral with the housing 910. In yet another embodiment, the portion of the tube 924 that includes the first inlet 926 and the second inlet 928 may be coupled to or integral with the cartridge 920.

Once the dispenser 900 is assembled, the user may actuate (e.g., press down on) the pump assembly 920, causing (1) the first liquid (e.g., water) in the internal volume of the housing 910 to be drawn into the tube 924 through the first inlet 926 of the tube 924 and (2) the second liquid (e.g., concentrated soap) in the internal volume of the cartridge 1000 to be drawn into the tube 924 through the second inlet 928 of the tube 924. Thus, the second liquid (e.g., concentrated soap) may be combined with the first liquid (e.g., water) in the tube 924 to form a mixture in response to the user actuating the pump assembly 920. The mixture may be ejected from the dispenser 900 through the outlet 930 of the pump assembly 920. In one embodiment, the mixture may be transformed into a foam as the mixture is ejected, thereby forming a foaming hand soap.

When the first liquid (e.g., water) in the housing 910 is at least partially exhausted, the user may decouple the lid 922 of the pump assembly 920 from the housing 910 and separate the pump assembly 920 from the housing 910. This may cause an upper portion of the tube 924 to be withdrawn from a lower portion of the tube 924. The user may then pour additional first liquid (e.g., water) into internal volume the housing 910. The user may then insert the upper portion of the tube 924 back into the lower portion of the tube 924 and couple the lid 922 of the pump assembly 920 to the housing 910 again. A frustoconical guide 932 may assist with inserting the upper portion of the tube 924 into the lower portion of the tube 924 or vice versa.

When the second liquid (e.g., concentrated soap) in the cartridge 1000 is exhausted, the user may decouple the cartridge 1000 from the housing 910. A base 916 coupled to the lower end 912 of the housing 910 may prevent the first liquid (e.g., water) from flowing out of the bottom of the housing 910. In addition, the second inlet 928 may include a valve (e.g., a one way valve) that prevents fluid from flowing out therethrough. The lower portion of the tube 924 may then be withdrawn from the cartridge 1000. The cartridge 1000 may either be disposed of or refilled with additional second liquid (e.g., concentrated soap). A new cartridge (or the refilled cartridge) 1000, containing the second liquid (e.g., concentrated soap), may then be positioned proximate to the lower end 912 of the housing 910 so that the lower portion of the tube 924 is once again inserted into the cartridge 1000, and the cartridge 1000 may be recoupled to the lower end 912 of the housing 910. The dispenser 900 may once again be ready for use.

What is claimed is:

1. A dispenser, comprising:

a housing defining an internal volume;

a cartridge coupled with the housing;

a pump assembly comprising a tube extending through the cartridge and into the internal volume of the housing, wherein the tube includes a first inlet through which a first liquid is drawn into the tube from the internal volume when the pump assembly is actuated, and a second inlet through which a second liquid is drawn into the tube from the cartridge when the pump assembly is actuated;

wherein the cartridge comprises a first portion having the second liquid disposed therein, and a second portion defining a bore through which the tube extends;

a connecting member that couples the first portion to the second portion, wherein the connecting member provides a flowpath from the first portion to an annulus formed between the tube and the second portion.

2. The dispenser of claim 1, wherein the first portion is positioned radially-outward from the second portion.

3. The dispenser of claim 1, wherein the tube, the first portion, and the second portion are concentric with one another.

4. The dispenser of claim 1, wherein the connecting member provides a flowpath from the first portion to the second portion.

5. The dispenser of claim 1, wherein the second inlet in the tube is axially-aligned and in fluid communication with the annulus.

6. The dispenser of any one of claims 1, 2-3, 4 and 5, wherein the first liquid and the second liquid are combined inside the tube to form a mixture.

7. The dispenser of claim 6, wherein the mixture is ejected from the pump assembly as a foam hand soap.

8. A method for using a dispenser, comprising:

pouring a first liquid into a housing;

coupling a cartridge with the housing, wherein a second liquid is disposed in the cartridge, wherein the cartridge comprises a first portion having the second liquid disposed therein, and a second portion defining an axial bore through which a tube of a pump assembly extends through the cartridge and into an internal volume of the housing, the cartridge further comprising a connecting member that couples the first portion to the second portion, wherein the connecting member provides a flowpath from the first portion to an annulus formed between the tube and the second portion;

inserting the tube of the pump assembly through the axial bore;

coupling a lid of the pump assembly to the housing; and actuating the pump assembly, thereby causing the first liquid to be drawn into the tube from the internal volume of the housing through a first inlet in the tube and the second liquid to be drawn into the tube from the cartridge through a second inlet in the tube.

9. The method of claim 8, wherein pouring the first liquid into the housing comprises pouring the first liquid through an axial opening in the cartridge after the cartridge is placed at least partially into the housing, wherein the axial opening is positioned radially-between the second portion of the cartridge and the first portion of the cartridge.

10. The method of claim 8, further comprising:

decoupling the lid of the pump assembly from the housing;

separating the pump assembly from the housing; and pouring additional first liquid into the housing through an axial opening in the cartridge.

11. The method of any one of claims 8-9, further comprising:

decoupling the lid of the pump assembly from the housing;

separating the pump assembly from the housing;

removing the cartridge from the housing; and placing a new cartridge at least partially into the housing.

* * * * *